US008591778B2

(12) United States Patent
Kang

(10) Patent No.: US 8,591,778 B2
(45) Date of Patent: Nov. 26, 2013

(54) METHOD AND APPARATUS FOR CONSTRUCTING RAILWAY FOR RUBBER-WHEELED AUTOMATED GUIDEWAY TRANSIT SYSTEM

(76) Inventor: Nam Hun Kang, Seoul (KR)

( * ) Notice: Subject to any disclaimer, the term of this patent is extended or adjusted under 35 U.S.C. 154(b) by 77 days.

(21) Appl. No.: 13/124,503

(22) PCT Filed: Dec. 31, 2008

(86) PCT No.: PCT/KR2008/007847

§ 371 (c)(1),
(2), (4) Date: Apr. 15, 2011

(87) PCT Pub. No.: WO2010/044514

PCT Pub. Date: Apr. 22, 2010

(65) Prior Publication Data

US 2011/0198767 A1 Aug. 18, 2011

(30) Foreign Application Priority Data

Oct. 17, 2008 (KR) ..... 10-2008-0102080
Oct. 22, 2008 (KR) ..... 10-2008-0103718

(51) Int. Cl.
*E04B 1/16* (2006.01)

(52) U.S. Cl.
USPC ..... 264/31

(58) Field of Classification Search
USPC ..... 264/31
See application file for complete search history.

(56) References Cited

U.S. PATENT DOCUMENTS

| | | | | |
|---|---|---|---|---|
| 4,523,542 | A | 6/1985 | Imahori et al. | |
| 2011/0198767 | A1 * | 8/2011 | Kang | 264/35 |

FOREIGN PATENT DOCUMENTS

| | | |
|---|---|---|
| JP | 07-059802 | 6/1995 |
| JP | 4156553 | 7/2008 |
| KR | 100120841 | 10/1997 |
| WO | WO 2005-042844 | 5/2005 |

* cited by examiner

*Primary Examiner* — Larry Thrower
(74) *Attorney, Agent, or Firm* — Greer, Burns & Crain, Ltd.

(57) ABSTRACT

A method and apparatus for constructing railways for a rubber-wheeled AGT system are provided. The method includes forming guideways, along which guide rollers of a light rail vehicle moves when the light rail vehicle runs along railways and forming, using a pressing unit of a finisher, the railways applied with concrete such that the railways have a same trace as the guideways by moving a finisher along the guideways. The apparatus includes a vehicle that is provided with rollers to run along guideways installed on vertical walls of a road bed and a pressing unit that is disposed under the vehicle to make lateral and longitudinal traces of railways correspond to lateral and longitudinal traces of the guideways by pressing and forming a top surface of railway concrete during the running along the guideways.

3 Claims, 7 Drawing Sheets

METHOD AND APPARATUS FOR CONSTRUCTING RAILWAY FOR RUBBER-WHEELED AUTOMATED GUIDEWAY TRANSIT SYSTEM

TECHNICAL FIELD

The present invention relates to a method and apparatus for constructing a railway for a rubber-wheeled automated guideway transit system, and more particularly, to a method and apparatus for constructing a railway for a rubber-wheeled automated guideway transit system, which can minimize construction costs and maximize construction efficiency by making it easy to construct the railway that linearly varies and eliminating post processes such as a grinding process and the like by improving construction precision.

BACKGROUND

Generally, a light rail vehicle system is classified into a steel-wheeled automated guideway transit (AGT) system, a rubber-wheeled AGT system, a linear induction motor (LIM) system, a monorail system, a streetcar light rail transit system, a maglev system, and the like.

Among the light rail vehicle systems, the conventional rubber-wheeled AGT system, is designed to use rubber tires similar to vehicle wheels 50 shown in FIG. 5 and drive along a fixed railways similar to railways 52 of a railway road bed 51. The driving of the vehicle W is guided by a guideway 54 installed on a vertical wall of the road bed 51 and guide rollers 55 installed on the vehicle W. The rubber-wheeled AGT system is constructed for a sub-circulation in a city or connection between a center of a city and a sub-centre of the city.

Since most of the light rail vehicle systems are generally constructed under the ground or above the ground, the driveway is complicated as the line of the driveway varies to be curved and inclined. The line of the driveway is basically designed to be straight and planar. However, when considering characteristics of the light rail vehicle system, there is a limitation that the driveway has no choice but to have curves and gradients.

In the related art rubber-wheeled AGT system structured as described above, the tires that are the rubber wheels 50 run along the railways 52. Therefore, the railways 52 of the light rail vehicle system have to be constructed to have a proper gradient in accordance with gradient of the driveway of the light rail vehicle so that the light rail vehicle can stably run.

For the rubber-wheeled AGT system, construction for constructing a guideway 54 at both outer sides of the railways 52 is performed.

That is, as shown in FIG. 6, steel bars 56 are arranged at places where the railways 52 will be constructed and a drain pipe and a system pipe are installed. Molds are installed around the arranged steel bars 56 to pour the concrete.

In order to arrange the steel bars 56, lateral steel bars are processed in advance in the factory in response to a gradient of the driveway in accordance with a design drawing. These lateral steel bars are carried to the site and combined with longitudinal steel bars in a rectangular shape. In order to arrange the steel bars 56 in response to the gradient of the driveway, a worker must precisely arrange the steel bars 56 in response to the longitudinal and lateral gradients of the driveway.

That is, in the straight driveway, heights of the steel bars are same as each other. However, as shown in FIG. 7, in the curved driveway, the steel bars 56 are inclined at a predetermined gradient so that the light rail vehicle can effectively turn. Therefore, in order to safely drive the light rail vehicle, it is very important to precisely arrange the steel bars 56'.

After installing the molds, adhesive such as epoxy resin is applied to the steel bars 56 and 56' and the concrete is poured into the molds, after which a top surface of the poured concrete is planarized.

Particularly, a machine is generally used to pour and planarize the concrete. However, since it is difficult to meet the gradient in the curved section of the driveway, the work manually meet the gradient.

After the concrete is flattened, flatness (error range is less than 1.2 mm/3 m) are measured.

After the concrete is poured and compacted, the concrete is cured for a predetermined time, after which the molds are removed. Subsequently, line grooves are formed using a concrete cutter and the like, after which a leveling layer for the waterproof and height adjustment of the road bed.

After forming the leveling layer, guideways 54 are installed on the vertical walls of the road bed in accordance with the design drawing. The guideways 54 are installed by measuring heights from the road bed 51 and thus the lateral and longitudinal gradients of the driveway can be very accurately set.

After the guideways 54 are installed, a test vehicle runs based on the road bed 51 to measure the lateral and longitudinal gradients of the railways 52. When a test result shows that there is an error in the longitudinal and lateral gradients of the railways 52. The railways 52 are ground or a concrete layer is thinly added to the railways 52 to fix the gradients.

SUMMARY

Technical Problem

However, when the steel bars are manufactured in a predetermined size in the factor in accordance with the design drawing, carried to the site, and arranged, it is difficult to arrange the steel bars in response to the predetermined lateral and longitudinal gradients and, as shown in FIG. 8, it is impossible to manufacture the steel bars corresponding to a gently curved section (see oblique lines) connecting the straight section to the curved section having a curvature R. Therefore, it is actually impossible to arrange the steel bars in response to the lateral and longitudinal gradients of the railways.

That is, as shown in FIG. 9, since the gently curved section connecting the curved section to the straight section has curvatures D1, D2, D3 that linearly vary, it is impossible to manufacture the steel bars corresponding to the gently curved section. Therefore, it is impossible to accurately form the gradients of the railways formed by the concrete applied around the arranged steel bars.

Further, when the grinding process is performed to fix the gradients after pouring the concrete, since the thickness of the concrete layer cannot be uniformly maintained, the strength of the concrete is deteriorated and thus cracked. In addition, thermal wires buried in the concrete may be exposed to the external side and thus damage.

In addition, since it is also impossible to arrange the molds that are installed for the pouring of the concrete in response to the curvatures and gradients of the gently curved section, the pouring precision of the railways is deteriorated.

Further, when the grinding process is performed in response to the gradients and curvatures design after pouring the concrete, the work has to manually perfume the measurement and grind the concrete. Therefore, the grinding precision is low and additional costs are incurred. This cause the increase of the construction costs of the light railway vehicle system.

Furthermore, since the curvatures and gradients of the guideways do not accurately correspond to the curvatures and gradients of the railways are accurately formed, the driving performance of the light railway vehicle is deteriorated and the riding comfort is deteriorated.

Therefore, the present invention has been made in an effort to address the above-described problems. It is an object of the present invention to provide a method and apparatus for constructing railways for a rubber-wheeled AGT system, which can accurately form the railways such that curvatures and gradients of the railways can accurately correspond to curvatures and gradients of the guideways, thereby improving construction efficiency, reducing construction costs, and improving driving performance of a light rail vehicle and riding comfort.

Technical Solution

To achieve the above-described objects, an embodiment of the present invention provides a method for constructing railways for a rubber-wheeled AGT system, including: forming guideways, along which guide rollers of a light rail vehicle moves when the light rail vehicle runs along railways; and forming, using a pressing unit of a finisher, the railways applied with concrete such that the railways have a same trace as the guideways by moving a finisher along the guideways.

In another embodiment, an apparatus for constructing railways for a rubber-wheeled AGT system includes a vehicle that is provided with rollers to run along guideways installed on vertical walls of a road bed; and a pressing unit that is disposed under the vehicle to make lateral and longitudinal traces of railways correspond to lateral and longitudinal traces of the guideways by pressing and forming a top surfaces of railway concrete during the running along the guideways.

Advantageous Effects

According to the embodiments, after the guideways are first constructed on the vertical wall of the road bed, the railways are constructed while running along the guideways so that the railways have the same trace as the guideways. Therefore, the construction of the driveway of the light railway vehicle system can be simplified and thus the construction costs can be reduced.

That is, in the related art construction method, the guideways are constructed after constructing the railways through engineering work. Therefore, the railways have a different trace from the guideways and thus post-process such as the grinding process and the like are required. This is time-consuming and costly. However, according to the present invention, the construction time and cost for the driveway can be significantly reduced.

BRIEF DESCRIPTION OF THE DRAWINGS

The above and other aspects, features and other advantages of the present invention will be more clearly understood from the following detailed description taken in conjunction with the accompanying drawings, in which.

DETAILED DESCRIPTION

Exemplary embodiments of the present invention will now be described in detail with reference to the accompanying drawings.

Figure 1:
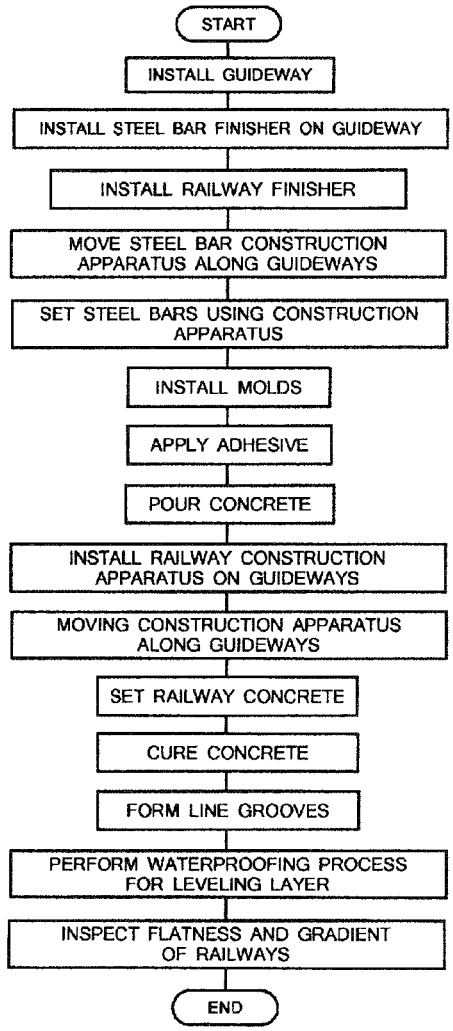
FIG. 1 is a flowchart illustrating a method for constructing railways for a rubber-wheeled AGT system according to an embodiment of the present invention.
Figure 2:
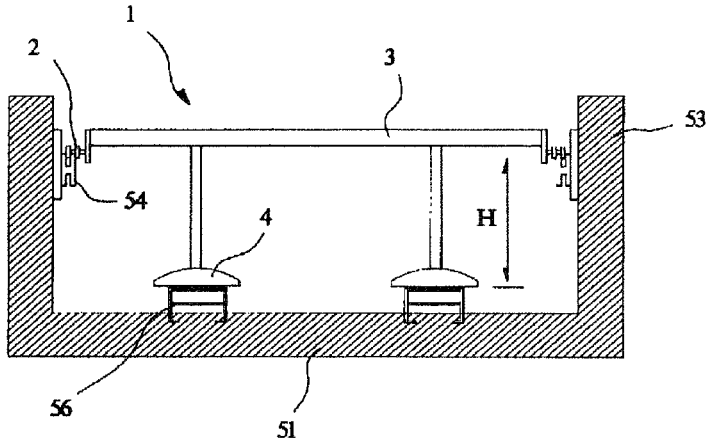
FIG. 2 is a schematic front view of an apparatus for constructing railways for a rubber-wheeled AGT system according to an embodiment of the present invention, illustrating an apparatus for steel bars.

FIG. 1 is a flowchart illustrating a method for constructing railways for a rubber-wheeled AGT system according to an embodiment of the present invention and FIG. 2 is a schematic front view of an apparatus for constructing railways for a rubber-wheeled AGT system according to an embodiment of the present invention.

Guideways 54 are constructed on vertical walls 53 of a road bed 51 in response to a guideway design drawing. Since the guideways 54 are fixedly installed on the vertical walls 53 of the road bed 51 after performing a location measurement for the road bed 51, the guideways 54 can be precisely constructed in response to the inclined gradient of the driveway.

That is, unlike railways constructed through civil engineering construction, the guideways 54 is constructed through a railway construction. Therefore, the guideways 54 can be simply installed on the vertical walls 53 in response to the design locations and thus it is possible to precisely install the guideways 54.

When the guideways 54 are constructed, the construction for the railways is performed. For this construction, a finisher 1 that is a construction apparatus is used. The finisher 1 is designed to make the installation gradient of steel bars 56 coincide with that of the guideways 54 while running along the guideways 54.

The finisher 1 includes a vehicle 3 that is provided with rollers 2 to run along the guideways 54 and a pressing unit 4 that is disposed under the vehicle 3 to make the lateral and longitudinal trace of the steel bars 56 correspond to the lateral and longitudinal traces of the guideways 54 by adjusting the lateral and longitudinal traces of the steel bars 56 by pressing and forming top surfaces of the steel bars 56 during the running of the finisher 1.

Figure 3:
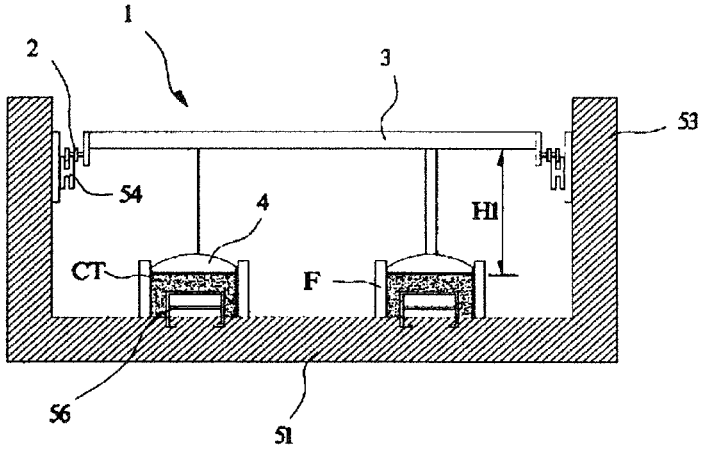
FIG. 3 is a schematic front view of an apparatus for constructing railways for a rubber-wheeled AGT system according to an embodiment of the present invention.
Figure 4:
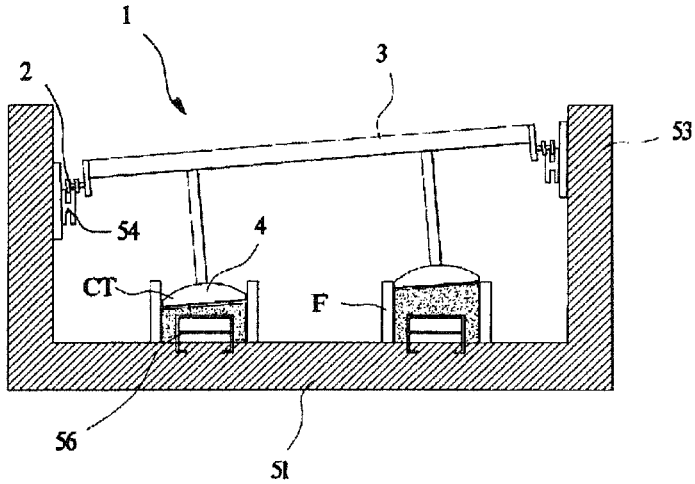
FIG. 4 is a schematic front view illustrating a constructing state of curved railways in FIG. 3.
Figure 5:
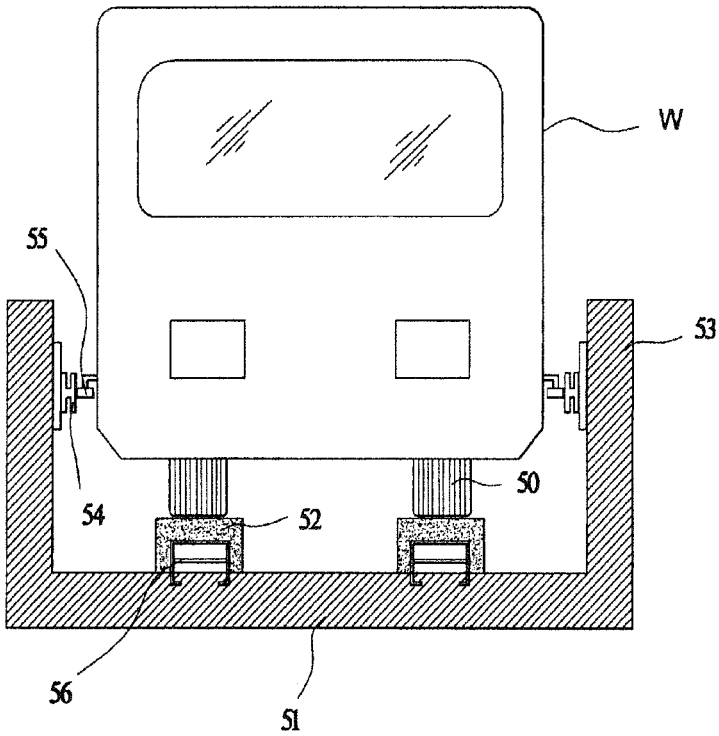
FIG. 5 is a schematic view of a driveway of a conventional rubber-wheeled AGT system.
Figure 6:
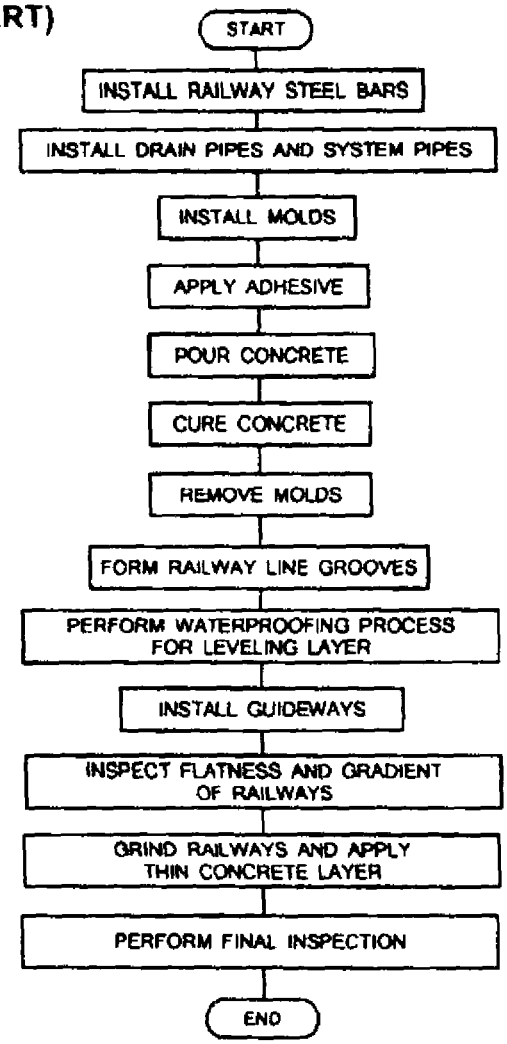
Fig. 6 (PRIOR ART)
FIG. 6 is a flowchart illustrating a conventional method for constructing railways for a rubber-wheeled AGT system.
Figure 7:
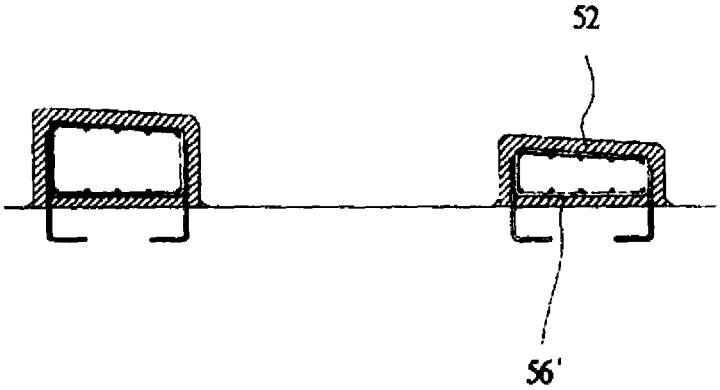
FIG. 7 is a schematic sectional view illustrating an arranged state of steel bars in a curved section in FIG. 5.

As shown in FIGS. 2 and 3, the finisher 1 is identically structured for the steel bars and the railways (concrete) except for the height of the pressing unit. That is, the pressing unit for the steel bars has a height H different from a height H1 of the pressing unit for the railways.

Here, the finisher for the steel bars may not be used and the steel bars are arranged in response to the design drawing through a basic construction and the gradient of the railways are formed using the finisher for the railways. Even in this case, the gradient of the railways can be precisely formed. However, when the finisher for the steel bars is separately used, the construction can be more precisely performed.

That is, since the gradient of the railways are adjusted after the concrete is poured, the installation precision of the steel bars may be sufficient through the basic construction and the gradient of the railways can be precisely adjusted using the finisher for the railways.

Needless to say, when the gradient of the arranged steel bars are precisely formed using the finisher for the steel bars, the thickness of the concrete (railways) surrounding the steel bars can be precisely and uniformly maintained and thus the service life of the railways can be increased.

When the worker arranges the steel bars 56 in response to the design drawing, the finisher 1 moves at a constant speed along the guideways 54, in the course of which the pressing unit 4 installed on the finisher 1 moves while pressing and forming the top surfaces of the arranged steel bars 56.

As a result, the steel bars 56 have same longitudinal and lateral traces (ingredients) as the guideways 54. Therefore, the steel bars 56 have the same traces as the guideways 54 even in the curved section.

After the installation of the steel bars is finished, drain pipes and system pipes are installed beside the arranged steel bars 56 and the concrete is applied around the arranged steel bars to construct the railways.

Next, the finish for the railways (the finish having the pressing unit whose height is adjusted to the height of the railways) 1 is suspended on the guideways 54 and molds F are installed around the arranged steel bars 56.

After the molds are installed, adhesive is applied on the arranged steel bars 56 and the concrete CT is poured into the molds, after which the finisher 1 runs along the guideways 54. Then, as shown in FIG. 3, the pressing unit 4 of the finisher 1 presses and forms the top surface of the concrete CT and thus the railways having a same trace as the guideways 54 can be constructed.

Figure 8:
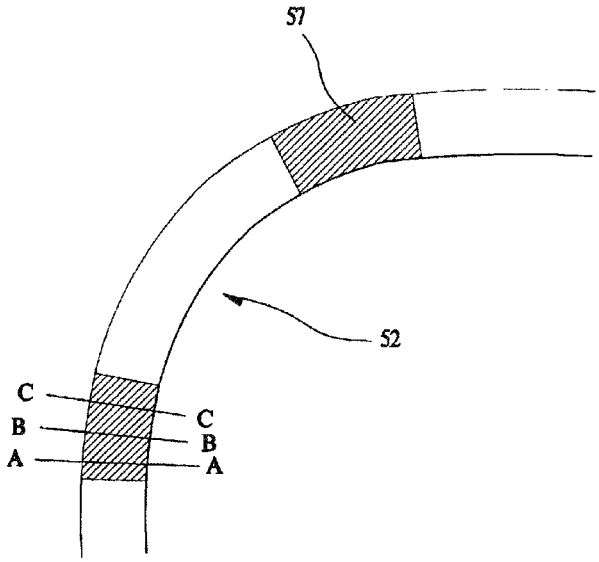
FIG. 8 is a schematic view illustrating a gently curved section in a curved section of a driveway.
Figure 9:
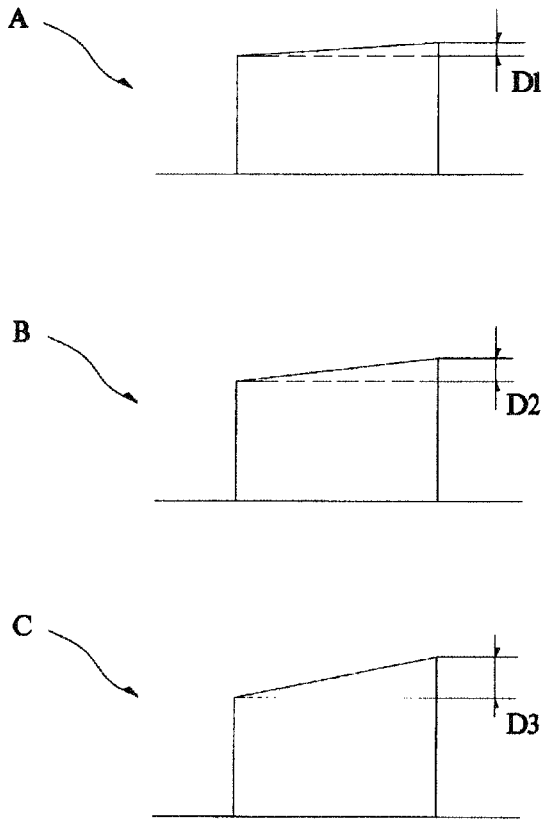
FIG. 9 is a sectional view of portions A, B, and C of FIG. 8, illustrating a linear gradient.

Particularly, as shown in FIG. 8, linear railway can be constructed even in a curved section, a straight section, and a gently curved section connecting the straight section to the curved section. Therefore, since the guideways 54 are already constructed in response to the gentle curve, the railways can be constructed to have the same gradient as the guideways 54.

As described above, when the longitudinal and lateral gradients of the steel bars 56 and the railways are formed as the finisher 1 runs along the guideways 54, the railways can be constructed in response to the design drawing based on the guideways 54.

When the railways are formed by the finisher, the concrete CT is cured and line grooves are formed.

After the above, the waterproofing process for the road bed leveling layer is performed and finally the flatness and gradient of the railways are inspected, thereby completing the construction of the railways.

The finisher 1 described above may be utilized for a light rail vehicle drive way that is already constructed. For example, the finisher 1 may be used to inspect if the railways 52 has the same lateral and longitudinal gradients (traces) as the guideways 54 while running along the guideways 54.

That is, since the finisher 1 runs along the guideways 54, it becomes possible to identify the erroneously constructed portions as the pressing unit 4 of the finisher 1 moves along the top surface of the railways 52. Therefore, when the erroneously constructed portion is lower than the reference value, the concrete is coated to meet with the reference value, and when higher, the erroneously constructed portion is ground to meet the reference value. As described above, the finisher 1 may be used in a post process (inspection process).

Figure 10:
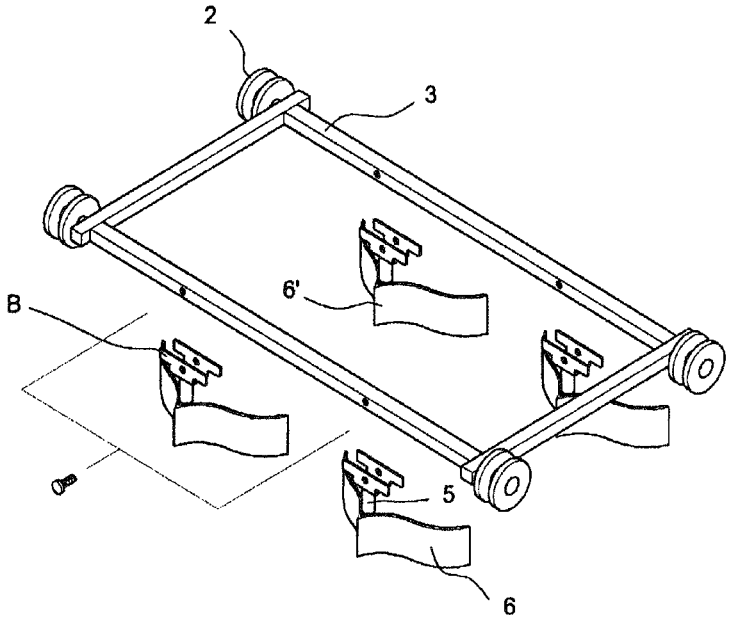
FIG. 10 is an exploded perspective view of a finisher that is a construction apparatus according to another embodiment of the present invention.
Figure 11:
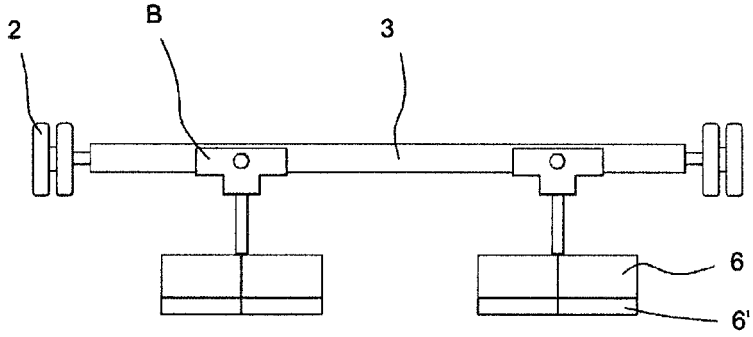
FIG. 11 is a side view illustrating an installation state of finishing members of FIG. 10.

FIGS. 10 and 11 show a finisher that is a construction apparatus according to another embodiment of the present invention.

The finisher includes a vehicle 3 that is provided with one or more rollers to run along guideways 54, an installing rod 5 fixed on an undersurface of the vehicle 3 by a bracket B, and finishing members 6 that are fixed on a lower end of the installing rod 5 and formed in a streamline shape in an advancing direction of the vehicle.

The finishing members 6 are installed in at least one line, for example, two lines. The front finishing members 6 are higher than the rear finishing members 6 and thus a plurality of forming processes are performed by the finishing members 6 and 6' at a time during the forming of the railway concrete CT, thereby more uniformly forming the railways.

That is, the front finishing members 6 first form the railways by cutting by a predetermined amount and the rear finishing members 6' cut the rest. That is, the forming is performed through two steps and the forming efficiency can be improved.

Needless to say, the finishing members 6, 6' may be installed in one line. In this case, the concrete can be formed through one process.

The streamline shape of the finishing members 6 and 6' reduces the frictional resistance as the vehicle 3 runs.

That is, a central portion acutely protrudes to define a front end portion 7 and wing portions 8 are formed by streamlining from the central portion so that the concrete flows out along the wing portions 8.

Further, as shown in FIG. 10, a pressing unit 9 for pressing the concrete cut by the front end of the finishing members 6 and 6' is formed under the finishing members 6 and 6'.

While the present invention has been shown and described in connection with the exemplary embodiments, it will be apparent to those skilled in the art that modifications and variations can be made without departing from the spirit and scope of the invention as defined by the appended claims.

The invention claimed is:

1. A method for constructing railways for a rubber-wheeled automated guideway transit system, comprising:

forming guideways on opposing walls of a road bed, wherein the guideways each include a lateral trace and a longitudinal trace;

forming railways using a finisher having rollers and a pressing unit, wherein the rollers are configured to enable the finisher to move along the guideways while the pressing unit presses and forms the railways such that the railways have a same lateral trace and longitudinal trace as the guideways.

2. The method of claim 1, further comprising:

installing steel bars on the road bed;

forming an outer surface of the steel bars to have a lateral trace and a longitudinal trace corresponding to the lateral and longitudinal traces of the guideways by pressing the outer surface of the steel bars with the pressing unit of the finisher as the finisher moves along the guideways.

3. The method of claim 2, further comprising:

applying concrete to the steel bars;

forming an outer surface of the concrete to have a lateral trace and a longitudinal trace corresponding to the lateral and longitudinal traces of the guideways by pressing the outer surface of the concrete with the pressing unit of the finisher as the finisher moves along the guideways.

* * * * *